United States Patent [19]

Nozawa et al.

[11] 4,261,180

[45] Apr. 14, 1981

[54] REFRIGERATOR

[75] Inventors: Shigekazu Nozawa; Masayuki Urashin; Hiroaki Kuno; Mitsuhiko Miyagawa; Hiroshi Takagi, all of Shimizu, Japan

[73] Assignee: Hitachi, Ltd., Tokyo, Japan

[21] Appl. No.: 974,494

[22] Filed: Dec. 29, 1978

[30] Foreign Application Priority Data

Jan. 6, 1978 [JP] Japan ..... 53-21778

[51] Int. Cl.[3] ..... G05D 23/30

[52] U.S. Cl. ..... 62/202; 62/222; 62/505

[58] Field of Search ..... 62/505, 210, 222, 202

[56] References Cited

U.S. PATENT DOCUMENTS

| | | | |
|---|---|---|---|
| 3,638,446 | 2/1972 | Palmer | 62/222 |
| 3,795,117 | 3/1974 | Moody, Jr. et al. | 62/505 X |
| 3,885,402 | 5/1975 | Moody, Jr. et al. | 62/505 |
| 3,931,718 | 1/1976 | Haselden | 62/510 |

*Primary Examiner*—William E. Wayner

*Attorney, Agent, or Firm*—Craig and Antonelli

[57] ABSTRACT

About 1 to about 25% by weight of a liquid refrigerant is mixed into a refrigerant gas to be introduced into a screw compressor by suction on the basis of the refrigerant gas in a refrigerator comprising a screw compressor, a condenser, and an expansion valve and an evaporator connected to one another in series. A cooling effect as well as a sealing effect can be satisfactorily attained thereby.

2 Claims, 4 Drawing Figures

REFRIGERATOR

Figure 1:
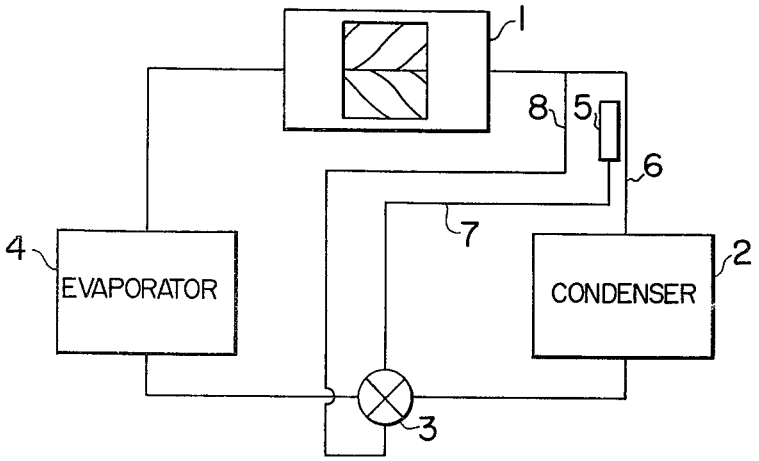

This invention relates to a refrigerator using a screw compressor, and more particularly to a refrigerator using a liquid refrigerant to be mixed into a suction gas to the screw compressor being controlled to an appropriate amount.

In the conventional refrigerator using a screw compressor, a large amount of oil is injected into the screw compressor to prevent a leakage of the refrigerant gas from a clearance at an intermeshing part between a male rotor and a female rotor or from a clearance between the male and female rotors and a casing inside wall and also cool the compressed high pressure gas, and cool the male and female rotors, the casing, etc. If such a large amount of oil is allowed to pass, as such, through heat exchangers such as a condenser, an evaporator, etc. together with the compressed gas, the oil will be deposited on the heat exchange surfaces of the heat exchangers, thereby impairing a heat transfer function of the heat exchangers and lowering performances of the heat exchangers. Thus, it is desirable to separate the oil from the compressed discharge gas and prevent the oil from passing through the heat exchangers as much as possible. To this end, an oil separator is provided in a conduit at the discharge side of the screw compressor to separate the oil from the discharge gas and prevent the oil from passing through other apparatuses of the refrigerator, particularly, heat exchangers, and also from accumulation therein.

On the other hand, the separated oil as such has a high temperature and is not suitable for reuse, and thus it must be cooled to an appropriate temperature for reuse. The cooling of oil is usually carried out in an oil cooler using water or other refrigerant as a cooling medium, and the oil cooler is provided as a unit in the refrigerator. Since such a large amount of oil is used in the conventional refrigerator using a screw compressor, an oil separator, and an oil cooler are indispensable for post-treatment and reuse of the oil, and these units are dimensionally so large that the entire refrigerator becomes large in size, making the cost of refrigerator disadvantageously high. Furthermore, a complicated structure of piping, valves, etc., connecting to these units are more complicated, and the oil flow or refrigerant gas flow is disturbed thereby. Once the oil flow or refrigerant gas flow is disturbed, a pressure drop due to a fluid friction appears, and thus the pipe diameter of piping must be increased correspondingly, or the sizes of valves, etc., must be made, for example, by one rank higher.

The use of such a large amount of oil has many problems as mentioned above, and in order to solve one of the problems, that is, a cooling problem, U.S. Pat. No. 3,885,402 proposes a process for cooling by injecting a liquid refrigerant in place of the oil cooling, where an appropriate amount of a liquid refrigerant is injected into a compression compartment from a restricted position after introducing the suction gas in the screw compressor. According to the proposed process, any oil cooler is not required, and thus the disadvantages such as the increase in the refrigerator size due to the use of the oil cooler and the use of a large amount of cooling oil can be eliminated, but another problem, that is, a problem of sealing a refrigerant gas leaking at the intermeshing part of the male and female rotors of screw compressor, or from the clearance between the male and female rotors and the casing inside wall is not solved yet by said proposed process.

U.S. Pat. No. 3,931,718 and Japanese Utility Model Publication No. 6698/71 propose to utilize a sealing effect of an injected liquid refrigerant. According to U.S. Pat. No. 3,931,718, a liquid refrigerant is injected into a compression compartment at a high pressure side of a screw compressor and allowed to pass from the high pressure side to the low pressure side within the compressor contrary to a refrigerant flow in a refrigeration cycle by utilizing a pressure difference between the high pressure side and the low pressure side, thereby attaining the sealing effect. According to Japanese Utility Model No. 6698/71, a portion of a liquid refrigerant is by-passed and injected into a compressor, thereby attaining the sealing effect.

An object of the present invention is to attain the cooling and sealing effect of compressed gas not by by-passing a portion of the liquid refrigerant and injecting it into a compression compartment, but by controlling a refrigerant circulating in a refrigeration cycle, that is, a refrigerant returning to the screw compressor from the evaporator, and also to form a refrigeration cycle for ensuring or improving a performance of the evaporator by the refrigerant control.

To attain said object of the present invention, the present invention provides a refrigerator comprising a screw compressor, a condenser, an expansion valve, and an evaporator, characterized by controlling an expansion valve provided at the inlet side of evaporator, thereby mixing an appropriate amount of a liquid refrigerant in a refrigerant gas to keep the refrigerant gas to be introduced into the screw compressor by suction always in an appropriately wetted state.

That is, in contrast to the conventional liquid refrigerant injection system of injecting the liquid refrigerant into the compression compartment on the way of compression in the screw compressor, a refrigeration cycle-circulating refrigerant, after having been heat exchanged in an evaporator, is introduced into a screw compressor by suction, while containing an appropriate amount of a liquid refrigerant therein, and thus the present invention can be called a liquid-back system in contrast to the conventional liquid refrigerant injection system.

According to the present liquid-back system, any special piping and control valve for passing the liquid refrigerant into the screw compressor, for example, a by-pass piping for guiding a condensed liquid refrigerant and a valve for controlling the condensed liquid refrigerant, etc. as in the liquid refrigerant injection system, are not required, and the entire refrigerator of the present invention can be much simplified. The valve for controlling a flow rate of the refrigerant so as to mix an appropriate amount of a liquid refrigerant into a refrigerant gas to be introduced into the screw compressor by suction is a special expansion valve provided at the inlet side of the evaporator, and the rate of opening of the expansion valve is controlled according to a temperature detected by a temperature-sensing tube provided in a piping line at the discharge side of the screw compressor.

Thus, the amount of the refrigerant to be passed and controlled by the special expansion valve is sufficiently more than the necessary amount for the heat exchange in the evaporator, and, in a case of a tightly sealed type screw compressor containing a motor therein, it corresponds to the amount of heat evolved from the motor part, the amount necessary for cooling and sealing in the screw compressor, and the amount necessary for maintaining an appropriate amount of the refrigerant in a liquid state.

As is obvious from the foregoing, the present invention provides not only a simplified refrigerator merely by replacing the liquid refrigerant injection system with a liquid-back system, but also a refrigeration cycle having a special expansion valve for ensuring and improving the performance of evaporator.

According to one mode of embodiments of the present invention, a hermetic screw compressor containing a motor therein, a condenser, an expansion valve, and an evaporator are connected to one another in series, and a temperature-sensing tube of the expansion valve is mounted in contact with a piping line at the discharge side of the screw compressor. The expansion valve is controlled to rapidly transfer a gas pressure of the temperature-sensing tube, which is increased proportionately to a temperature as detected at the piping line at the discharge side of the screw compressor. To improve the response, a heating means is provided at the head part of the expansion valve for heating the tightly sealed refrigerant.

Figure 2:
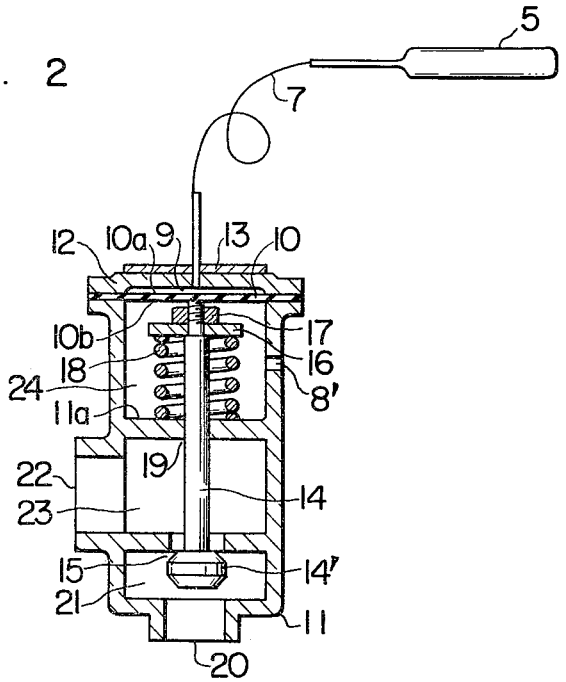
Figure 3:
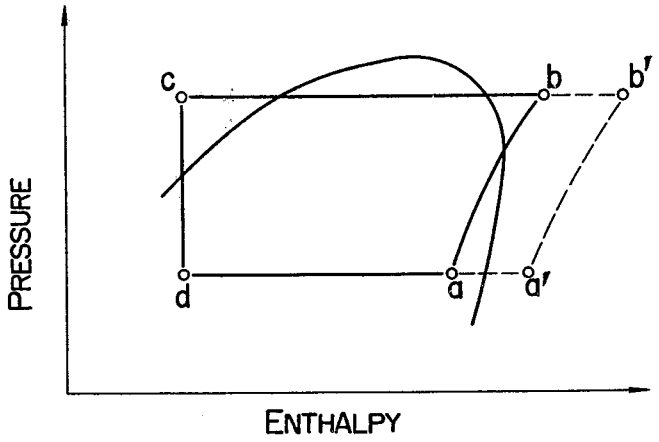
Figure 4:
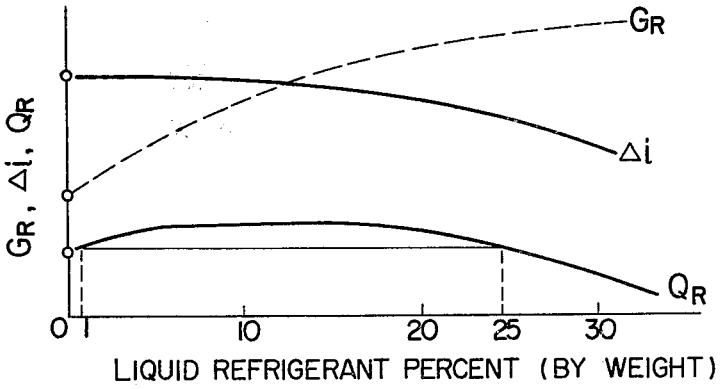

One mode of embodiments of the present invention will be described in detail, referring to the accompanying drawings, where FIG. 1 is a schematic diagram of refrigeration cycle depicting the base of the present invention, FIG. 2 is a cross-sectional view of an expantion valve controlling the refrigerant in a refrigeration cycle of the present invention and a temperature-sensing tube, FIG. 3 is a cycle graph shown on a Mollier chart, where dotted lines are a cycle according to the conventional art, and full lines are a cycle according to the present invention, and FIG. 4 is a diagram showing changes in refrigerant circulation amount $G_R$, enthalpy difference $\Delta i$, and cooling capacity $Q_R$ against liquid refrigerant percent, attained by refrigeration cycle control according to the present invention.

In FIG. 1, numeral 1 is a hermetic screw compressor containing a motor therein, numeral 2 a condensor, numeral 3 an expansion valve, and numeral 4 an evaporator, and they are connected in one another in series by piping. Numeral 5 is a temperature-sensing tube, which a refrigerant gas is sealed in, and mounted in contact with a piping line 6 at the discharge side of the screw compressor. Numeral 7 is a capillary tube connected to communicate the temperature-sensing tube 5 with a tightly sealed space 9 formed on a diaphragm 10 at the head part of the expansion valve 3. Numeral 8 is a pressure-equalizing pipe.

In FIG. 2, the temperature-sensing tube 5 is communicated with the tightly sealed space 9 by the capillary tube 7. The tightly sealed space 9 is formed by the diaphragm 10 deformable by an applied pressure, and a cover 12 fixed to an expansion valve body 11 in a tightly sealed state so as to pinch the diaphragm 10. Numeral 13 is a heating means closely mounted on the wall of the cover 12 so as to heat the refrigerant sealed in the tightly sealed space 9 through the cover 12. For example, an electric heater, etc. are suitable as the heating means 13. In FIG. 2, the heating means such as the electric heater, etc. is mounted on the outside surface of the cover 12, but can be fixed on the inside surface of the cover 12 in the tightly sealed space 9 so as to directly contact the refrigerant. Numeral 14 is a valve stem provided with a valve head 14' at the lower end thereof, and in FIG. 2 the valve stem is mounted in a vertically movable state so as to freely change a clearance of throttle 15 provided at the body 11. The other end of the valve stem 14 is in contact with the lower side of the diaphragm 10, and is screw-threaded. A nut 17 is screwed on the threaded part of the valve stem through a stopper 16. The lower side of the stopper 16 is brought in contact with a spring 18. The spring 18 with an appropriate spring force is inserted between the stopper 16 and a wall **11*a* of the body 11. The valve stem 14 is gas-tightly sealed at a penetration part 19 of the wall 11*a*. Numeral 20 is a high pressure liquid inlet, which is open to a high pressure compartment 21 where the valve head 14' is encased. Numeral 22 is a low pressure liquid outlet which is open to a low pressure compartment 23 communicating with the compartment 21 through the throttle 15**.

A space 24 is filled with a high pressure refrigerant gas from a connection opening 8' to which the pressure-equalizing pipe 8 is connected. The position of the valve stem 14 is set mainly by a balance between a force $F_1$ exerted by the spring 18 through the stopper 16 and the nut 17, and a force $F_2$ exerted by the diaphragm 10 in a direction opposite to said force $F_1$, that is, a balance represented by such a formula as $F_1 \cong F_2$. Among these forces, the force $F_1$ exerted by the spring 18 is a force proportionate merely to the deflection of the spring 18. On the other hand, the force $F_2$ exerted by the diaphragm 10 is given by such a formula as $f_2 = f_1 - f_2$, where $f_1$ is a force exerted by a pressure on an upper surface **10*a* of the diaphragm 10 and $f_2$ a pressure on a lower surface 10*b* of the diaphragm 10. Among these forces, the force $f_1$ is a force exerted by the pressure of saturated refrigerant gas containing a liquid sealed in the temperature-sensing tube 5, the capillary tube 7 and the tightly sealed space 9. The heating means 13 such as an electric heater, etc. is operated, that is, starts to heat only when a liquid refrigerant, among the liquid refrigerant and refrigerant gas sealed in the temperature-sensing tube 5 and the tightly sealed space 9, is accumulated in the tightly sealed space 9, and the temperature of electric heater as the heating means 13 is controlled, so that the refrigerant gas can be retained only in the tightly sealed space 9 and the liquid refrigerant only in the temperature-sensing tube 5. The heating means 13 can be operated when the refrigerant temperature in the tightly sealed space 9 becomes lower than the refrigerant temperature in the temperature-sensing tube 5. Thus, the temperature of the discharge gas, which the temperature-sensing tube 5 can detect, evaporates the liquid refrigerant sealed in the temperature-sensing tube 5 and determines a pressure $P_1$ in the tightly sealed space 9, and further determines the force $f_1 = P_1 \times S_1$, where $S_1$ is an area of the upper surface 10*a* of the diaphragm. On the other hand, the force $f_2$ is a force exerted by introducing a pressure Pd of discharge gas at the high pressure side from the connection opening 8' provided at the body 11 into the space 24, and can be represented by such a formula as $f_2 = Pd \times S_2$, where $S_2$ is an area of the lower surface 10*b* of the diaphragm. Thus, said force $F_1$ can be given by $F_1 \cong F_2$, thus by $F_1 \cong f_1 - f_2$, thus by $F_1 \cong P_1S_1 - PdS_2$. Suppose $S_1 = S_2 = S_0$ for facilitating the understanding, $F_1$ can be given by $F_1 = (P_1 - Pd) \times S_0$. The pressure $P_1$ in the tightly sealed space 9 is a pressure given by an intersection of an isothermal line and a critical line on a Mollier chart corresponding to a discharge gas temperature, and the saturation temperature corresponding to the pressure $P_1$ is substantially equal to the discharge gas temperature detected by the temperature-sensing tube 5 of the expansion valve 3. Thus, the pressure $P_1$ is determined by the discharge gas temperature. Furthermore, the force $F_1$ exerted by the spring 18 is determined by a pressure difference of $P_1-Pd$, that is, a difference between the discharge gas temperature and a saturation temperature corresponding to the discharge gas pressure. Once the spring force $F_1$ is determined thereby, the valve stem 14 moves to determine the clearance of the throttle 15. Thus, when the discharge gas temperature is elevated, the rate of opening of the throttle 15 in the expansion valve is increased, and the refrigerant circulation amount is thus increased. The rate of opening of the throttle 15** is such as to contain about 1 to about 25% by weight of a liquid refrigerant in the refrigerant gas, on the basis of the refrigerant gas, at the suction inlet of the screw compressor.

As described above, the heating means plays an important role in the function of the expansion valve. That is, since the temperature-sensing tube 5 is mounted in contact with the piping line 6 at the discharge side, the temperature of the temperature-sensing tube 5 is equal to the piping temperature at the discharge side of the screw compressor and substantially equal to the discharge gas temperature, that is, a considerably high temperature. On the other hand, the mounting position of the expansion valve is in the piping on the way to the inlet side of the evaporator 4, and thus is exposed to an atmosphere at a considerably lower temperature than the mounting position of the temperature-sensing tube 5. That is, the refrigerant sealed in the temperature-sensing tube 5 is liable to be condensed and liquefied in the tightly sealed space 9 at the expansion valve side at the lower temperature. Whenever the temperature-sensing tube 5 can detect the discharge gas temperature in such a state, only the gas is heated in the temperature-sensing tube, causing only a small increase in pressure, since the temperature-sensing tube is full only of the gas and has no accumulation of the liquid refrigerant. Thus, the characteristics equal to the saturation pressure and temperature characteristics obtained when the liquid refrigerant exists cannot be obtained in such a state, and the expansion valve cannot be satisfactorily operated. To avoid such a state, it is necessary that a liquid refrigerant always exists also in the temperature-sensing tube 5. This means that, whenever the expansion valve should be satisfactorily operated, the heating means 13 at the head part of the expansion valve is operated to control the temperature in the tightly closed space 9 to be higher than the temperature in the temperature-sensing tube 5.

A refrigerant having a critical pressure as low as possible is suitable as the refrigerant to be sealed in the temperature-sensing tube 5 and the tightly sealed space 9. Examples of the suitable refrigerants include R-113, R-114, etc.

The control of refrigeration cycle according to the present invention will be described by way of a refrigeration cycle on the Mollier chart shown in FIG. 3..

In the conventional refrigeration cycle, the state at the outlet of evaporator is given by a', which reaches point b' after introduction of the refrigerant gas into the screw compressor by suction in a superheated state, and successive compression thereof.

Then, the compressed refrigerant gas passes to the condenser, and is condensed and liquefied, and pressure-reduced at point c by the expansion valve, and reaches the inlet side of evaporator at point d. Viscosity of the perfect gas at point a', that is, the point of discharge from the evaporator and introduction into the compressor by suction is about $1.1\times10^{-6}$ kg.s/m$^2$ at a temperature of 0° C., whereas the viscosity of the liquid at the same temperature is about $20\times10^{-6}$ kg.s/m$^2$. That is, the viscosity of the liquid is about 20 times as high as that of the perfect gas.

The present invention is based on such foregoing fact and maintains the outlet of evaporator, that is, the point of suction into the compressor, at point a in a wetted state, thereby bringing about such a state that some liquid refrigerant is always mixed in a refrigerant gas. Then, the refrigerant gas is compressed from point a to point b and is allowed to pass into the condenser. Since the gas leakage is substantially inversely proportional to the viscosity, the increase in the viscosity to 20-fold can reduce the gas leakage from the compression compartment of the screw compressor and the compressor performance is greatly improved by the increased sealing effect. Furthermore, inclusion of the liquid refrigerant can naturally improve the effect of cooling the compressed gas, motor, etc.

The point a in the wetted state can be arbitrarily selected and controlled, as far as it is in the range of wetted state. The practical range is a range of about 1 to about 25% by weight of the liquid refrigerant in the refrigerant gas on the basis of the refrigerant gas. If the point a of outlet from the evaporator is shifted toward the left side to make the wetted state approach the saturation liquid curve as shown in FIG. 4, an enthalpy difference $\Delta i$ is reduced correspondingly, but the rate of opening of the throttle 15 of the expansion valve is increased, and the refrigerant circulation amount $G_R$ is increased proportionately to the liquid refrigerant amount. Thus, a cooling capacity $Q_R$, represented by product of the refrigerant circulation amount $G_R$ and the enthalpy difference $\Delta i$, has an increasing tendency, and increases if the amount of liquid refrigerant is in a range of about 1 to about 25% by weight in the refrigerant gas on the basis of the refrigerant gas.

It can improve the heat exchange efficiency of the evaporator to retain the liquid refrigerant throughout the evaporator, and thus this can serve also to make the size of the evaporator smaller.

According to the present invention, a refrigeration cycle is so controlled that about 1 to about 25% by weight of a liquid refrigerant is mixed in a refrigerant gas to be sucked into a screw compressor on the basis of the refrigerant gas, and thus an effect of cooling the motor in the hermetic screw compressor and the compressed gas, and a sealing effect to prevent a gas leakage from a clearance between male and female rotors and a clearance from the rotors and the casing can be attained. Furthermore, in contrast to the system of bypassing and injecting a liquid refrigerant into the compressor, any special by-pass pipings, control valves, etc. are not required, and the refrigerator can be much simplified. Furthermore, the state of refrigerant gas at the outlet of evaporator is controlled to a wetted state, and thus the cooling capacity of the evaporator is correspondingly improved. The improvement in the cooling capacity of the evaporator can make the size of the evaporator smaller, and also can make the refrigerator more compact. Furthermore, the discharge gas temperature can be lowered by the latent heat of evaporation of the liquid refrigerant introduced into the screw compressor by suction, or vice versa, and thus the operation of screw compressor can be operated while always stabilizing the discharge gas temperature, and thus the cooling capacity of the refrigerator can be always stabilized. The present invention can provide so many significant practical effects as mentioned above.

What is claimed is:

1. A refrigerator comprising a screw compressor, a condenser, an expansion valve, and an evaporator, characterized by a temperature-sensing tube of the expansion valve being mounted in contact with a piping of a discharge side of the screw compressor, a tightly sealed space communicating with the temperature-sensing tube being provided over a diaphragm of the expansion valve, a heating means being provided on a wall of the tightly sealed space for heating the tightly sealed space to a temperature higher than the temperature in said temperature-sensing tube so that among a liquid refrigerant and refrigerant gas sealed in the temperature-sensing tube and the tightly sealed space, the liquid refrigerant may be accumulated in the temperature-sensing tube and the refrigerant gas accumulated in the tightly sealed space whereby about 1 to about 25% by weight of liquid refrigerant can be mixed in the refrigerant gas to be introduced into the screw compressor by suction on the basis of the refrigerant gas.

2. A refrigerator according to claim 1, wherein the heating means is an electric heater.

* * * * *

UNITED STATES PATENT AND TRADEMARK OFFICE

CERTIFICATE OF CORRECTION

PATENT NO. : 4,261,180

DATED : April 14,1981

INVENTOR(S) : Shigekazu Nozawa;Masayuki Urashin;Hiroaki Kuno;Mitsuhiko Miyagawa; Hiroshi Takagi It is certified that error appears in the above-identified patent and that said Letters Patent are hereby corrected as shown below:

On the Title Page, lefthand column:

" [30] Foreign Application Priority Data

Jan. 6, 1978 [JP] Japan.....53-21778"

should read:

--[30] Foreign Application Priority Data

Jan. 6, 1978 [JP] Japan.....53-217--

Signed and Sealed this

*Eighth* Day of *September 1981*

[SEAL]

*Attest:*

GERALD J. MOSSINGHOFF

*Attesting Officer*

*Commissioner of Patents and Trademarks*